US006865864B2

(12) United States Patent
Katz

(10) Patent No.: US 6,865,864 B2
(45) Date of Patent: Mar. 15, 2005

(54) INLINE FORMED CROSSFOLD PACKAGE AND METHOD

(76) Inventor: Robert E. Katz, 80 Old Hollow Rd., Short Hills, NJ (US) 07078

( * ) Notice: Subject to any disclaimer, the term of this patent is extended or adjusted under 35 U.S.C. 154(b) by 25 days.

(21) Appl. No.: 10/158,149

(22) Filed: May 31, 2002

(65) Prior Publication Data

US 2003/0222127 A1 Dec. 4, 2003

(51) Int. Cl.[7] ..... B65B 11/48

(52) U.S. Cl. ..... 53/460; 53/459; 53/461; 53/569; 493/356; 493/216

(58) Field of Search ..... 493/356, 216, 493/917, 480, 919, 921; 53/460, 569, 568, 459, 461, 466, 131.5, 206

(56) References Cited

U.S. PATENT DOCUMENTS 3,579,947 A * 5/1971 Kalman ..... 156/204
3,618,284 A * 11/1971 Gendron ..... 53/411
3,665,817 A 5/1972 Katz et al.
3,784,185 A 1/1974 Katz
3,808,768 A 5/1974 Dobbs
4,012,268 A * 3/1977 Johnsen ..... 156/200
4,205,504 A * 6/1980 Gregoire et al. ..... 53/520
4,312,169 A 1/1982 Golicz et al.
4,464,878 A 8/1984 Golicz et al.
4,852,795 A 8/1989 Volk, Jr.
4,931,035 A 6/1990 Schmidt
4,939,888 A * 7/1990 Katz et al. ..... 53/411
5,197,262 A * 3/1993 Katz et al. ..... 53/550
6,073,421 A 6/2000 Lee

OTHER PUBLICATIONS

★★Note Dobbs 768 and Lee 421.

* cited by examiner

*Primary Examiner*—Eugene Kim
*Assistant Examiner*—Sameh H. Tawfik
(74) *Attorney, Agent, or Firm*—Shlesinger, Arkwright & Garvey LLP

(57) ABSTRACT

An inline formed package having an envelope and insert material, is formed from a single repeat of a printed web both of which are crossfolded simultaneously, approximately along the half repeat line, and the area of the insert material is greater than half the area of the repeat.

10 Claims, 7 Drawing Sheets

INLINE FORMED CROSSFOLD PACKAGE AND METHOD

FIELD OF INVENTION

This invention relates to a new type of inline formed package particularly useful for the direct mail industry, and a new inline method for its manufacture.

BACKGROUND OF THE INVENTION

Producing advertising and promotional items for mass distribution, whether by mail or newspaper, for example, requires a high speed and low cost printing and forming capability. High speed printing and inline forming of these items, such as advertising mailers and coupon packages, has been the most cost effective manner of making these items.

A large publication printing press also used for printing magazines is generally used because of its speed and wide web printing capability. These presses normally print a web of about 30 inches in width at speeds of up to 3000 feet per minute. The printing press prints on the web a series of identical printed sections called a repeat. These sections are the width of the web, and the longitudinal length equals the circumference of the printing cylinder. One typical printing cylinder circumference is 22 inches. Previously, when the publication press is used for direct mail items, where the web is subsequently processed inline, two or more identical mailer prints with both envelope and insert material, must be printed end to end within one repeat.

A printed web is subsequently formed when it passes through a number of inline processing stations, including, adhesive application, personalized laser or inkjet imaging, perforating, folding, or ribboning, assembling, and cutting to produce the finished product. The finished product, if it is an advertising mailer, is produced at the web speed by this inline processing operation to produce a ready to mail, and postal zip number sorted mailer.

The forming of the envelope to enclose the advertising contents is accomplished by a longitudinal folding of the envelope portion of the web along the longitudinal axis of the envelope and over the advertising content section. The previously applied adhesive then holds the folded over envelope sections together as a completed envelope. The longitudinal folding operation described requires that two or more advertising mailers be printed end to end in one repeat.

Frequently, to supplement the amount of advertising material that is to be enclosed in a given mailer, additional printed advertising material must be added inline before folding of the envelope. However this requires a second printed web and registration of the two webs, before the envelope folding stage. This procedure is costly, since difficulties are encountered with respect to maintaining registration between the two webs. If a break in the web occurs, this further complicates the registration and correlation of the webs, particularly if there is personalization data specific to each envelope and its insert mailer piece, that must be matched. These extra problems are not inconsequential, and may amount to as much as 30 to 50 percent in additional cost for a given product.

Similarly, separate independent production of the envelope and the printed insert material, and, subsequent mechanical stuffing of the envelope is a costly alternative. This method is a more costly process than inline production. Although, the inline method is more efficient and less costly, there is need for improving the inline process to enable a single inline web to provide more insertable material and more varieties of format.

With conventional inline printing and converting, the printed material for an item is confined to no more than one half repeat of the web. Confining the printed material for an item on the web to no more than one half of repeat restricts the ability to make, from one web, a larger envelope product, add more printed insert material, or to vary the format of the printed content, of the inline package. Only half of the web repeat area is available for an item because a web can only be folded along the long axis of the envelope requiring two folds to enclose printed contents and form the envelope.

Accordingly, there is a need to overcome this limitation of an inline printing method, and to use a full repeat area, thereby providing a more versatile and substantially larger inline package.

SUMMARY OF THE INVENTION

This invention provides a new type of inline produced package from a printed web which contains substantially more advertising and insert material than previously possible.

The variable envelope configuration of this invention allows flexibility of manufacture that enables variations in the type and construction of the enclosed material, not possible with conventional inline equipment.

This invention also allows packages requiring a large amount of printed material to be enclosed in an envelope, without requiring a second web to provide additional printed material. The use of a second web is costly, since additional equipment is required, and mechanical problems can occur with ink-jet or other variable imaged printing, folding, web breakage and web registration.

This invention recognizes that a full impression of the web, that is a full repeat of the web can be used for one envelope to provide added insert material and additional half repeat web area available for a package, this allows for variation in size and shape of the package, particularly for the use of larger size packages, and for more insert and advertising material for an envelope.

This invention makes it possible to use smaller printing presses that are not practical for many inline items.

This invention also recognized that presently, a crossfold of the combined web elements cannot be made after the web passes through the inline forming operations, and this prevents using the full impression of the printing press, that is, the whole printed repeat.

This invention overcomes the limitation of the previous printed inline processing, which restricted web area to one half or less of the printed repeat. With this invention the crossfold can be made at or close to the half repeat line, to form one side of the envelope and to also crossfold the enclosed printed material. The full repeat area can be used when the end of the web is crossfolded back on itself along the half repeat line, and severed from the following repeat. It has been found that a commercial publication folder unit can be modified to crossfold an inline produced mailing package of this method.

The additional web area available for a given item doubles, thereby permitting more area for both enlarging the package size, or including more advertising material or other marketing pieces such as coupons, returned envelope, or order forms. The ratio of web area usable for the insert material is at least twice the area of the web envelope.

In those instances where the particular envelope and the accompanying contents are specifically directed to an individual to whom the envelope is addressed, this personalized information is by inkjet imaged or other variable printing means onto the printed items in the common repeat. In this manner, although the individual items will be separated and subsequently brought together in the envelope, there is no chance for mismatch of personalization on the envelope and enclosed documents, since all of the pieces comes from a common web which is proceeding through the inline stages simultaneously.

Consequently, a second web carrying personalized insert material to be added to the envelope content, is not needed, and there is no possibility of breakage or speed differential with the second web which can result in mismatch of the personalized items and the envelope. The added capability of including more material on the common web, avoids this potential problem.

The added available area, also makes it possible to produce from a common web, many additional pages of a booklet or pamphlet, otherwise not previously possible with previous inline produced articles.

The inline crossfold package, is also more user friendly, since it has an open end and adjacent sides lightly held together by releasable adhesive, so that the recipient can readily pull the package open.

The method of the invention contemplates the use of a commercial publication folder unit, which is modified to accept the ends of the combined ribbons and to commonly crossfold them along approximately the one half repeat line of each repeat and then sever the folded product from the web in successive operations. No commercial publication folder unit has been previously used for this purpose nor has a crossfold on a full repeat at the one half repeat line for a printed inline converting assembly been used heretofore. The ability to employ a modified commercial publication folder provides a reliable processing stage which is considerably less costly than custom designed equipment.

The inline crossfold method adds a new dimension of versatility at substantially less cost than otherwise possible.

The versatility of the equipment, also introduces an economy of equipment costs, since there is less need to rearrange and adjust equipment to make different types of items.

The introduction of a crossfold to the web permits the use of high speed equipment not normally workable for many direct mail type products. Additionally, short press runs of multi-page printed items becomes economically feasible.

DESCRIPTION

Figure 1:
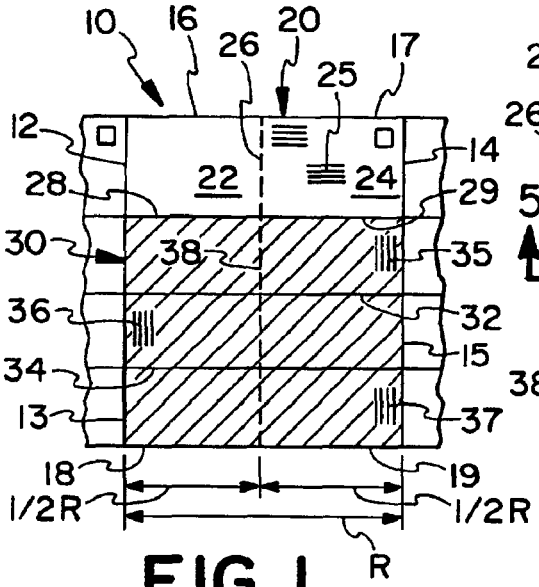
FIG. 1 is a plan view of a full repeat section of a printed web for a package of the subject invention.

A mail package illustrating the invention is shown in FIGS. 1 to 5. The package is formed from a full repeat section of a printed web, as illustrated in FIG. 1 for a web width of 36 inches. The common repeat section of the web generally indicated at FIG. 1 is one of a succession of identically printed repeats made by each revolution of a printing press print cylinder. The boundary lines 12 and 14 are adjacent to identically printed repeat sections. The edges 16 and 18 are the edges of the printed web. The repeat has an envelope section 20 and an insert section 30 which are the two main parts of the content of the web repeat. The envelope back panel 22 and the envelope address panel 24 are joined along a common fold line 26.

The repeat length R is the longitudinal distance along the web between the leading end 12, 13 and the trailing end 14, 15 of the repeat 13 and 15. The one half repeat line is significant. It is the crossfold line, for both the envelope section and the insert material sections. It coincides with the fold line 26 between the envelope panels 22 and 24, and is located along the transverse dotted line shown in 26. The back panel 22 and the address panel 24 of the envelope section are folded about this line. The width of the panels 22 and 24 can be changed to vary the size of the envelope, but the dimensions of sides 16 and 17 are not variable, except possibly for small trim of the envelope.

The lower sides 28 and 29 of the envelope, and the other edge of the web 18, 19, together with the lines 13 and 15 define the insert area 30 of the web repeat. The insert area may be printed either linearly parallel to the line of web travel or perpendicular to it. As shown, it can be divided into three longitudinal strip sections by lines 32 and 34. Inkjet or other variable imaged printing of personalized information, 35, 36 and 37 is shown on each of the three insert sections. It is related to the inkjet printed address 25 on the front envelope panel 24. For example, the name of the addressee may be placed on the insert material wherever desired. The use of a larger insert area and imaging on a common web eliminates use of a costly second web.

During processing the envelope panels 22 and 24 are separated from the web as part of a continuous ribbon of similar envelope sections differing only by imaged personalization, such as the address 25.

In this utilization of the invention, the three longitudinally extending sections of the insert 30 are independently folded over each other along lines 32 and 34 to form a continuous folded ribbon. This ribbon is then brought together underneath the envelope ribbon, and subsequently both ribbons are simultaneously crossfolded along the half repeat line 26, 38. This closes the envelope panels 22 and 24 about the folded insert 30. It is then separated from the end of the two superposed envelope and insert webs.

Figure 2:
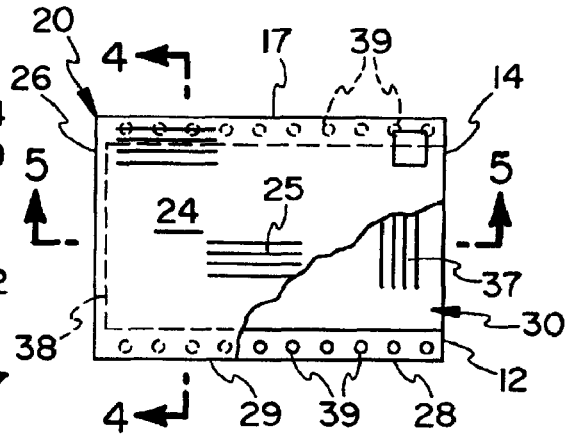
FIG. 2 is an enlarged plan view of the completed crossfold package of the subject invention.

FIG. 2 shows the assembled package with a partial cut away of the front envelope panel 24. The crossfolded side 26 corresponds to the dotted fold line 26 in FIG. 1.

The lower corner of the envelope panel 24 is cut away along the side edges 14 and 29 to show the insert 30.

Figure 4:
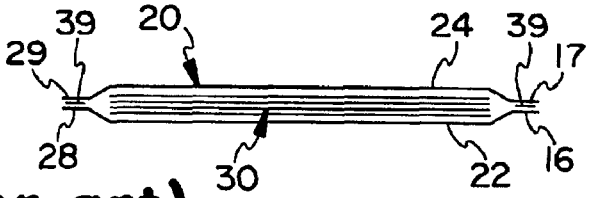
FIG. 4 is an enlarged cross section of FIG. 2 along line 4—4.

The envelope section top edges 16 and 17 and the bottom side edges 28 and 29 of the envelope are held together by spaced dots of latex contact adhesive 39, as shown in the cross section of FIG. 4.

Figure 3:
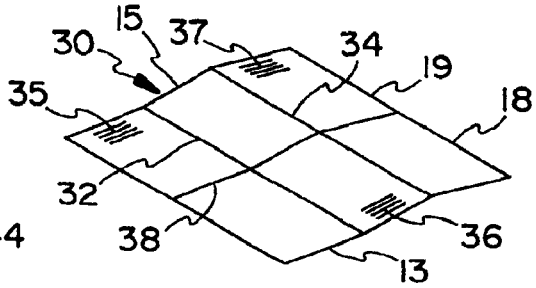
FIG. 3 is a perspective enlarged view of the advertising insert of FIGS. 1 and 2.

The insert piece 30 as shown in the perspective in FIG. 3 is a large poster size item.

As mentioned previously, the webs are printed on large publication presses and the width of the printed web is about 36 inches. The circumference of the printing cylinder, and consequently the longitudinal length of the Repeat, of FIG. 1 is normally in the range of 17 to 22 inches depending on the press used. The crossfold envelope size is approximately 6×9. Consequently, it can be seen that the insert 30 is a large folded piece approximately 20×30 inches. The advantage of such a large printing insert piece in a 6×9 envelope is only possible when the area of the whole repeat area of the web can be used.

In addition to the large size envelope and the amount of insert area provided, the envelope construction also can readily be opened.

Figure 5:
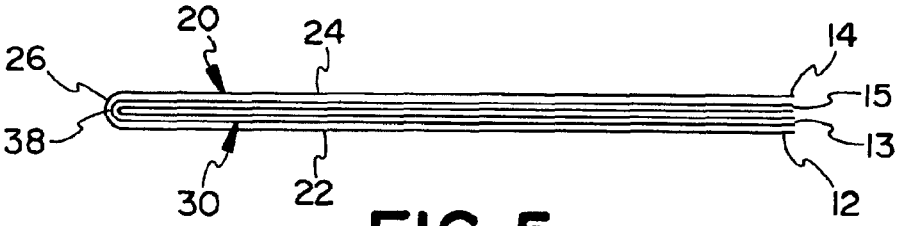
FIG. 5 is an enlarged cross section of FIG. 2 along line 5—5.
Figure 7:
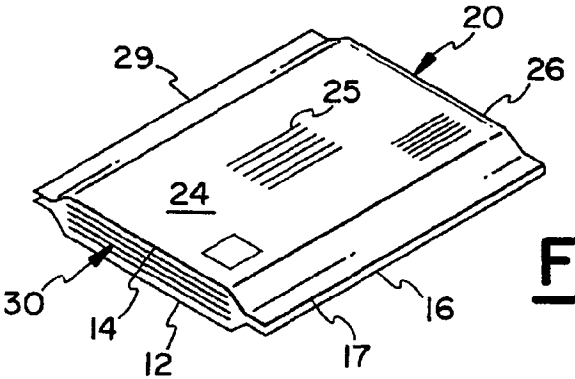
FIG. 7 is an enlarged end perspective view of the inline crossfold package of FIG. 2.

The cross sectional view of FIG. 5 shows that the side edges 12 and 14 are not joined together. FIG. 2 also shows that the adhesive holding the top and bottom side of the envelope together is a series of spaced latex adhesive dots 39. The opened edges 12 and 14 of the envelope 20 can be readily pulled apart to separate the adhesive dots along the top edges 16, 17, and the bottom edges 28, 29, as the panels separate.

Figure 6:
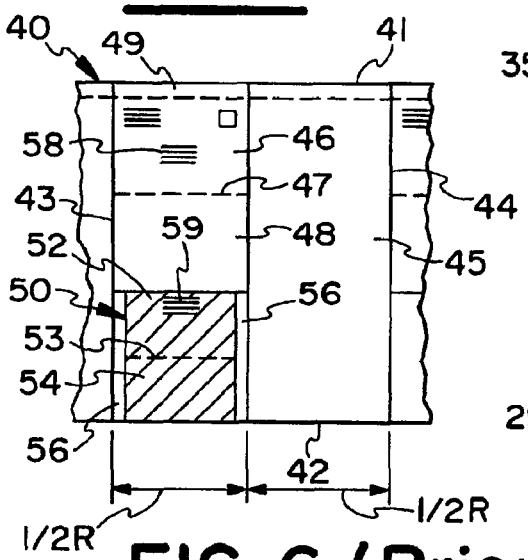
FIG. 6 (Prior art)
FIG. 6 is a plan view of a printed web repeat of the prior art.

The advantage of the new inline crossfold package over the previously available direct mail capability is very substantial. Reference to FIGS. 1 and 6 decidedly shows the significant difference in the insert size capability of the two methods.

FIG. 6 shows the prior art, current inline repeat area available for advertising material. The repeat for the FIG. 1 repeat 10, is the same size as repeat 40 of FIG. 6.

The side edges 41 and 42 of the web FIG. 6 corresponds to the side edges 16 and 19 of FIG. 1. The repeat length between the boundary sides 43 and 44 is the same as the boundary lines 13 and 15 of the repeat of FIG. 1. However, since the crossfold technique was not available, each envelope is restricted to only a one half repeat area with the prior art process. The entire one half repeat area 45 is unusable except for another envelope. The front address panel 46 in FIG. 6 can only be folded longitudinally along the web line of travel on the long axis of the envelope along line 47. This requires that the back panel 48 of the envelope is restricted to the first half section of the repeat 40. Envelope flap 49 is folded to close the envelope. Both these panels 46, and 48, are the same size as the envelope panels 22 and 24 of FIG. 1.

It can be seen that in this respect, the requirement of both panels in the first half repeat makes it impractical to use a large envelope configuration with a one pass inline web technique. The cross-hatched areas of FIGS. 1 and 6 very graphically show the significance of the one half repeat restriction of typical inline printing, particularly where larger envelopes are required.

The insert area 50 is restricted to the small panels 52 and 54, which are longitudinally folded or slit along line 53. A further negative of the typical inline processing is shown by the reduced area sections 56 on both sides of the panels 52 and 54. These sections must be removed from the web to provide clearance between the adhesive glue strips that must be applied along the side edges of the envelope.

The ability to ink-jet image personalized information common to both envelope and inserts is also shown. The address information 58 on the front address panel 56 can be applied to panel 52 as shown at 59. But the opportunity for much more personalization in a common web is not possible.

Figure 8:
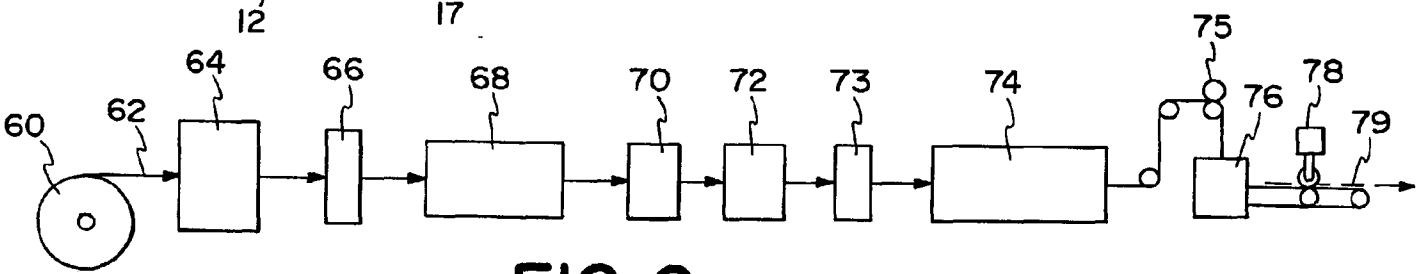
FIG. 8 is a block diagram of the inline crossfold method of the subject invention.

FIG. 8 shows schematically the successive processing operations for the inline crossfold method. A large roll of paper 60 supplies a web of paper 62 to a large high speed publication press 64. The printed web of paper has pattern glue applied at 66. The web passes through the dryer at 68 to an ink jet imaging stage 70 where personalized data is applied to both the envelope and insert sections of the web simultaneously.

The web may be notched at 72, or pattern perforated at 73. The perforations are made for coupon and stamp items, if they are to be used.

The web then proceeds to section 74 where the envelope section is separated from the insert section of the web. The location of the cut determines the envelope width. Additional separation of the insert section may be made if multiple page format is required. If the desired material is a folded item, such as shown in FIGS. 2 and 3, the insert section 30 will be kept intact, and will be longitudinally folded.

The separated envelope and insert webs are then brought together and superposed and passed through a nip roller 75. The component ribbons of successive envelopes and insert material are passed through a modified publication folder unit 76 where they are crossfolded and individually perpendicularly cut separated from the ribbons. The separated packages then pass on a conveyer through a pneumatically operated nip roller assembly 78 which presses down on to the side edges of the envelope firmly engaging the adhesive, to complete the forming of the finished package 79.

Figure 9:
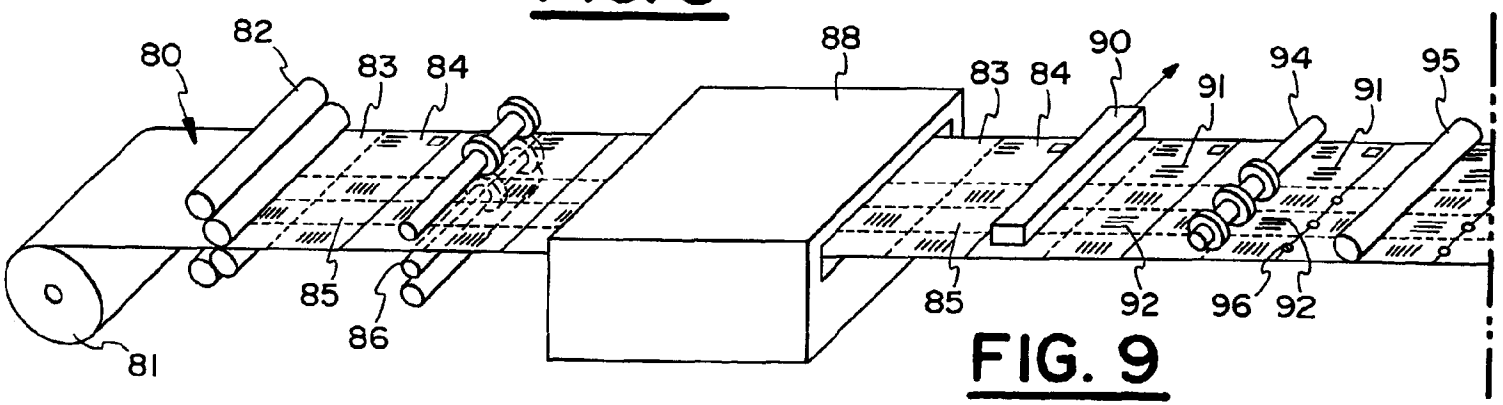
FIG. 9 is a perspective view of the printing and initial inline processing stages of the method.

FIG. 9 is a more detailed perspective showing of the process of FIG. 8 illustrating the changes that take place on the web as it proceeds through the various operational stages. The web 80 is moved from a paper roll 81 through a publication printing press 82 where successive repeats are printed. The repeat shown on the web has envelope back panel 83 and front address panel 84, and the insert printed section 85, leaving the web and proceeding to the pattern glue station 86. Here the dots of the latex contact adhesive are applied to the underside of the web. The web then proceeds through the drying station 88 to the imaging station 90 where personalized data 91 and 92 are applied to the envelope and to the insert material sections of the successive repeats. The web then proceeds under the notching stage 94 where adhesive dot clearance holes 96 are notched in the web. The last process on the whole uncut web is shown at 98, where pattern perforations for coupons, tear-off stubs and stamps are made.

Figure 10:
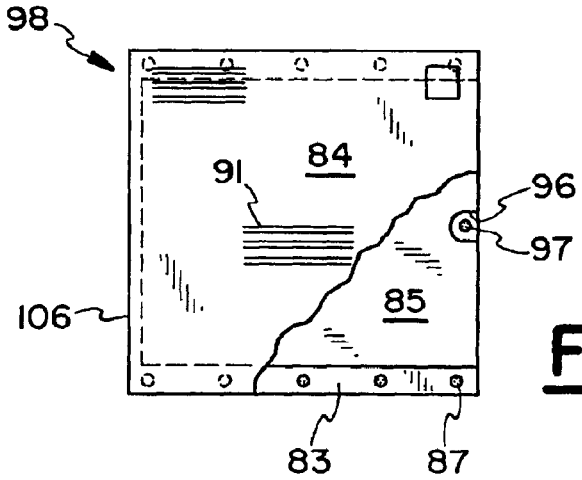
FIG. 10 is a plan view of the completed envelope of the web shown in process in FIG. 9.

Reference has been made to the notching operation in both FIGS. 8 and 9. FIG. 10 shows the assembled web of FIG. 9, generally indicated at 99. The address panel 84 has been cut away to show the dot clearance hole opening 96 at the edge of the insert 85. A dot of adhesive 97 passes through the clearance holes 96 made in the web by the notching unit 94 of FIG. 9. This dot of adhesive is applied to the underside of the back panel 83, in order to secure and close the open end of the package, if desired. The line of adhesive dots 87 along the outer sides of the back panel were applied at the glueing stage at the roller section 86 on the underside of the web.

Figure 11:
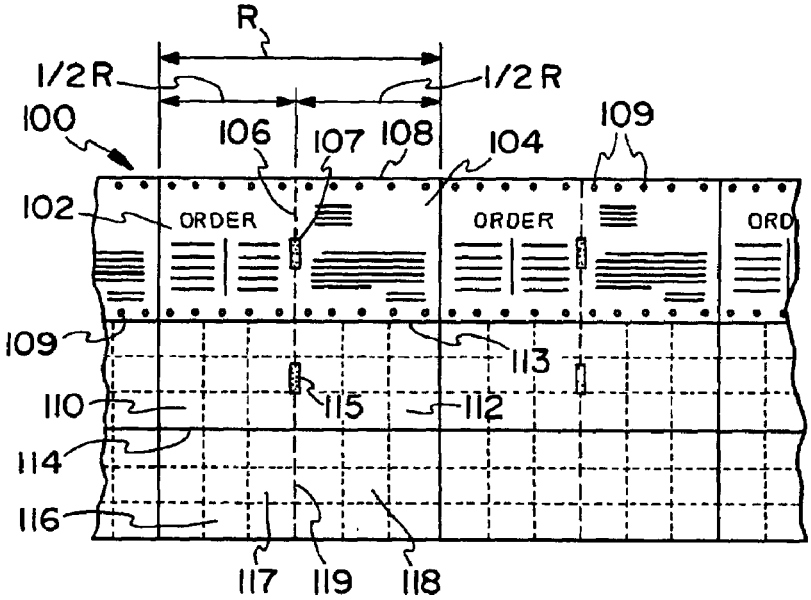
FIG. 11 is a plan view of the underside of the web after the initial stages of FIG. 9.

FIG. 11 shows the underside of another web configuration generally indicated at 100. The Repeat section is divided into one-half repeat sections on either side of the one-half repeat line, along which the crossfold of all pieces will be made.

The underside of the address panel has a printed order form 102 and the underside of the back panel also has a printed correspondence piece 104 adjacent to each other along line 106 which eventually will become a crossfold line for the envelope piece. A spine glue strip 107 is applied along line 106 for placing the item in booklet form after assembly. Along the underside edge 108 of the envelope panels, a series of spaced adhesive dots 109 have been applied for holding the package together after the crossfolding operation.

The first of four coupon panels, 110, 112, 116, and 118, (cross hatched area) will be separated from the order form on the inside surface of the envelope panel section along line 113. Panels 110 and 112 will be separated along line 114 from the lower coupon panels 116 and 118. All of the panels have coupon items 117 of different types which are can be removed by the recipient from the panels along the dotted perforations shown. A strip spine adhesive is placed along the half repeat line 119, to eventually hold the two panel coupon sections together after crossfolding.

Figure 12:
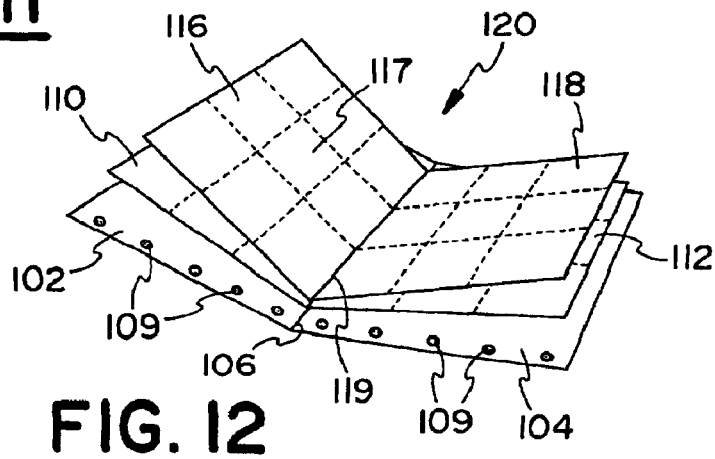
FIG. 12 is a perspective view of the subsequently assembled insert section of FIG. 11.

FIG. 12 shows in perspective the assembled booklet formed from the web shown in FIG. 11. It should be noted that the interior surfaces of the two envelope panels are also available for providing additional printing area as shown in FIG. 11.

The assembled booklet generally indicated at 120 is a coupon booklet in which the individual crossfolded components are held together by the spine adhesive strips 107 and 115 to provide a usable coupon booklet having letter-size pages for small instruction manual booklets, or a stamp book. If the size of the envelope and booklets is reduced, the number of pages can be increased significantly. This is the distinction between the ordinary in-line produced items, which have less than half the capability of producing a multi-page booklet from a single web.

Figure 13:
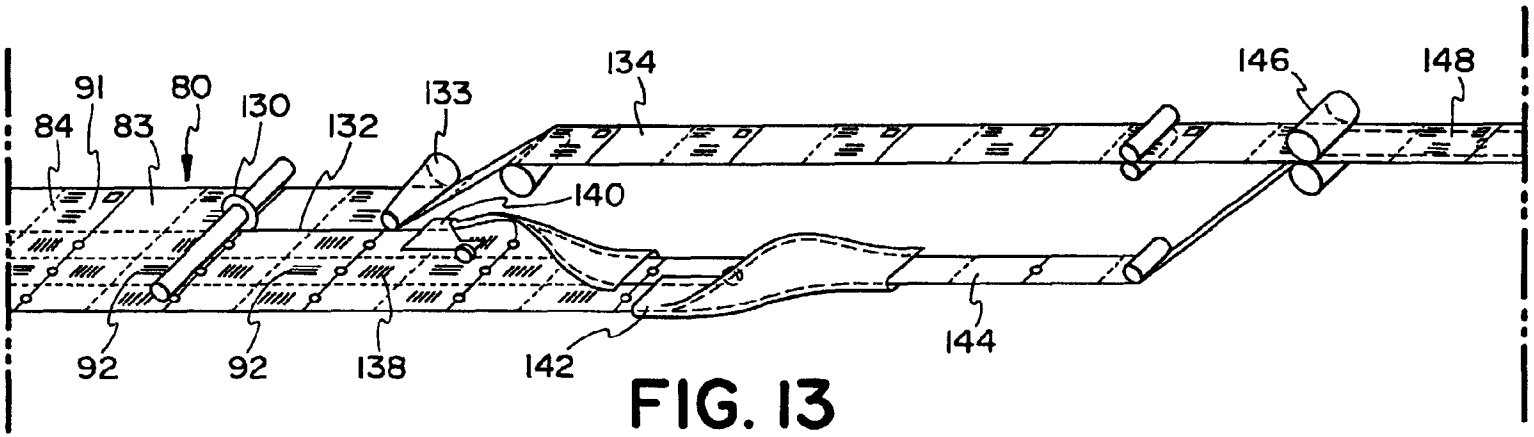
FIG. 13 is a perspective schematic view of the web in process showing separation of the envelope and longitudinal folding of the printed insert section of the web.

FIG. 13 shows the intermediate phase of the process, and is a continuation of the web processing method of FIG. 9. The web 80, on leaving the perforating station 98, enters the web separating and ribbon forming stage, of section 74 of FIG. 8. The ribbon slitter 130 cuts the web longitudinally along line 132 to separate the envelope portion of the web from the printed insert section 138. The width of the slit ribbon determines the envelope width.

Turn bar assembles schematically indicated at 133 place the separated ribbon of successive envelope panels 134 up above the printed insert section 138. Folding plows shown at 140 and 142 produce a three ply ribbon at 144. A fold operation could produce a "C" or a "Z" fold. The two fold configuration would be similar to that shown in FIGS. 1 and 3 previously. After the folding operation the envelope ribbon and the inserted ribbon are brought together at 146 and move in-line as a composite ribbon 148.

The longitudinal folding of the printed insert section of the web, illustrates the manner of folding conventually used with the in-line processing of web items ordinarily with in-line folding, the envelope panels must be located adjacent to one another, separated by a longitudinal fold line such as 47 in FIG. 1, and folded in this manner.

In conventional inline practice, the printed insert ribbon, such as 144, is positioned over the envelope ribbon above one of the envelope panels and cut to separate the individual insert pieces. The insert pieces are than dropped onto the envelope ribbon and the other envelope panel is simply folded over it to enclose the inserts between the envelope panels.

In contrast, the in-line crossfold method of this invention brings the envelope ribbon and the continuous insert ribbon together, with envelope ribbon 134 over the ribbon 144, as illustrated at 146 and 148. The fold of the envelope over the web material is a crossfold transverse to the direction of web travel. Consequently as mentioned with reference to FIG. 1, both half repeat sections of the web can be used for a single envelope. This cannot be done with the conventional longitudinal fold operation. Also, since this is better controlled by a continuous insert web, one quarter inch less clearance from the glue-line is required.

Figure 14:
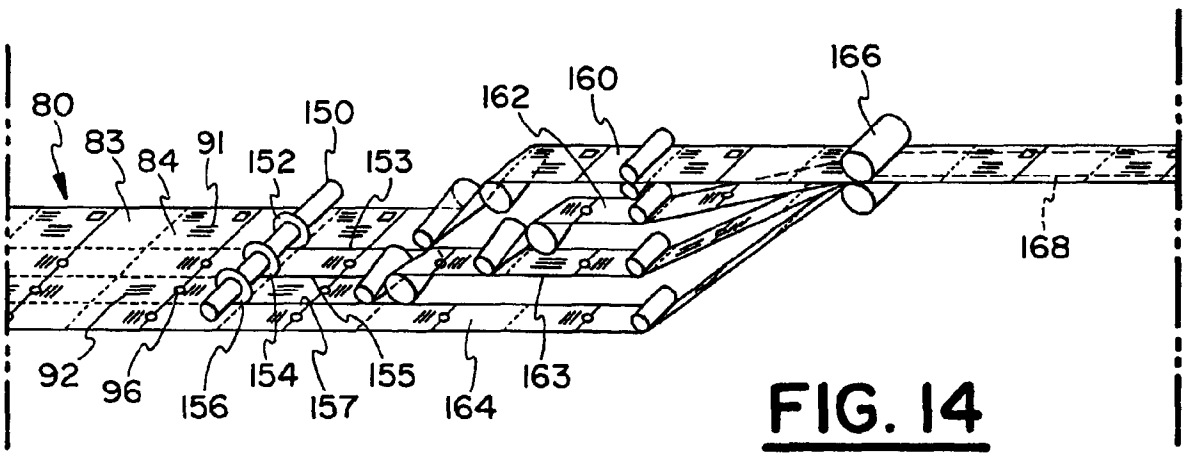
FIG. 14 is a perspective schematic view of the web in process showing separation of the envelope section and the ribboning of the printed insert section of the web.

FIG. 14 illustrates the option of cutting of the printed insert section of the web of FIG. 9 into separate individual ribbons to produce a multiple page product such as shown on FIG. 12.

The web 80 after leaving the perforated stage 98 of FIG. 9, is shown at 80 in FIG. 14. It should be noted that the three previous stages of ink-jet printing 90, the notching stage 94, and the perforating station, may not have been required. The operation of these inline stations is solely dependent upon the product to be produced.

In FIG. 14, the web 80 with the repeat 83-84 has received address data 91 from the ink-jet imaging station 90, and related personalization data 92 for the insert. Notches 96 have been made on the web as shown. The web passes under the shaft 150 carrying rotating knife blades 152, 154, and 156. As the web passes under these rotating blades, the web is slit at 153, 155, and 157.

The envelope ribbon 160 is moved by a turn bar assembly, schematically shown, to an upper position. The printed insert ribbons 162, 163, and 164 are moved into position underneath web 160 at 166 to produce a composite ribbon 168. The composite ribbons 148, and 168 have the envelope ribbon above the printed insert ribbon material. In each of these cases the following crossfold operation is the same for both of these ribbons.

Figure 15:
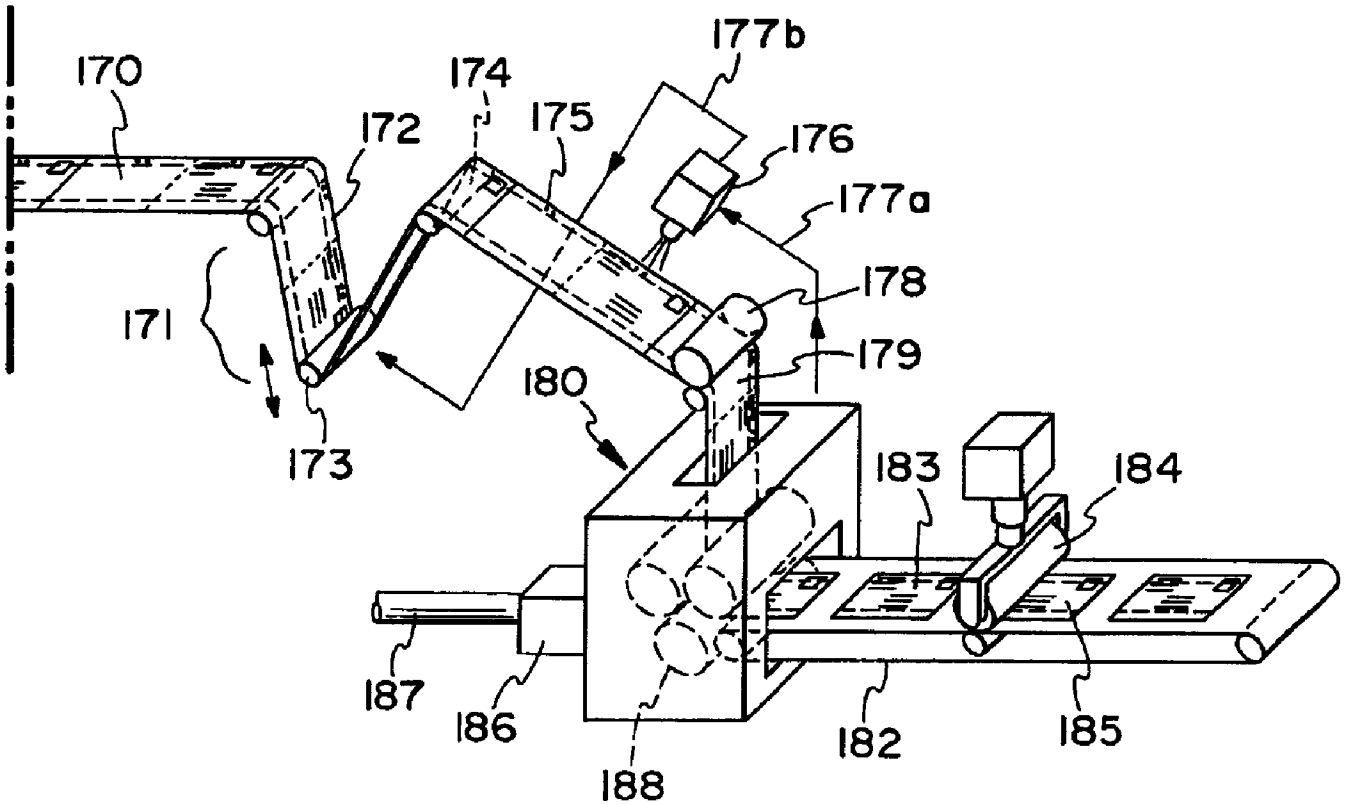
FIG. 15 is a perspective schematic view of the final processing of the web through the modified publication folder assembly.

FIG. 15 schematically shows a continuation of the processing of the composite ribbons. Composite ribbon 148 or composite ribbon 168, is subsequently crossfolded in the same manner.

The composite ribbon (either 148 or 168) is shown at 170 prior to entry into the modified commercial publication folder unit generally indicated at 180.

These standard type commercial folder units are used to receive and crossfold magazine signatures, and are not usable for inline direct mail webs. It was recognized that a publication folder unit could possibly accept and operate on a composite inline direct mail composite ribbon, if the folder unit could be modified to accept direct inline operations, and the mechanical power input and incoming composite web could successfully be interfaced with the publication folder. The folder unit first stages were removed, and adjustments made to take advantage of the crossfold and the cutter stages in the publication folder unit. The publication folder unit is ordinarily designed for much larger webs. The ability of the folder unit to operate successfully was uncertain. Tests showed that with modified input, to accept a composite inline direct mail web, such as web compensation, and nip rollers, the folder unit could be operated successfully, to both receive and crossfold the composite web.

As shown in FIG. 15, the composite web 170 passes over roller 171 and passes down as shown at 172 to subsequently pass through compensation roller 173. The compensation roller is continuously controlled to move up and down to vary the length of the web feed into the folder 180. The web then passes up and over roller 174. Registration marks 175 along the edge of the web are sensed by a photocell, and are equally spaced from each other. The scanner and control unit 176 scans the web to read for the registration marks 175, which are equally spaced on the composite web 170 which passes down into the modified publication folder unit 180. The scanner and control unit 176 receives an input signal along line 177*a* which correlates with the timing mark to provide a deviation signal. This signal is passed out over line 177*b* to the control for the compensating roller mechanical control assembly (not shown) for varying the movement of the compensation roller 173 either up or down. This is an important function that enables it to correct any disparity in registration between the incoming web and the crossfold assembly and the folder unit 180.

The web then passes through the nip feed adjusting rollers 178. To accurately guide the composite web 179 down into the modified publication folder unit 180.

The size of the crossfold cylinders is matched to the publication press printing cylinders. The crossfold is designed to fold each successive repeat of the incoming web in half. The crossfold of the web would therefor be along the half repeat line of each successive repeat. Test runs made with the modified publication folders unit indicated that the location of the crossfold was sufficiently accurate to be successfully used for direct mail items.

The folder section of the unit folds the end repeat back on itself along the half repeat line, and then the severs the folded repeat from the end of the web. The separated completed package 183 is then carried by conveyer 182 as shown to the pneumatic pressured nip rollers 184 to compress the sides of the front and back panels of the envelope firmly against the adhesive to produce a finished package 185.

An important part of the interface of the mechanical folding unit is the mechanical connection to the modified publication unit 180. Ordinarily, the publication folder is located within three to four feet of the power train of the printing press and the mechanical power input is supplied to the unit at that point. The folder is also offset to the side of the press and delivers the folded signatures perpendicularly do the line of travel of the web through the printing press. In this invention, the modified folder unit has to be located at the end of the inline forming stages, about fifty feet distant. Mechanical shaft power must be supplied to the folder 180 at that point, and also the direction of the folder output is changed to an inline position to operate with the incoming composite web. Input shaft power is provided from the end of the inline processing through shaft 187 through a mechanical transmission unit 186, mechanically designed to coordinate the rotational speed of the crossfold and cutting cylinders generally shown at 188, to the composite web.

Figure 16A:
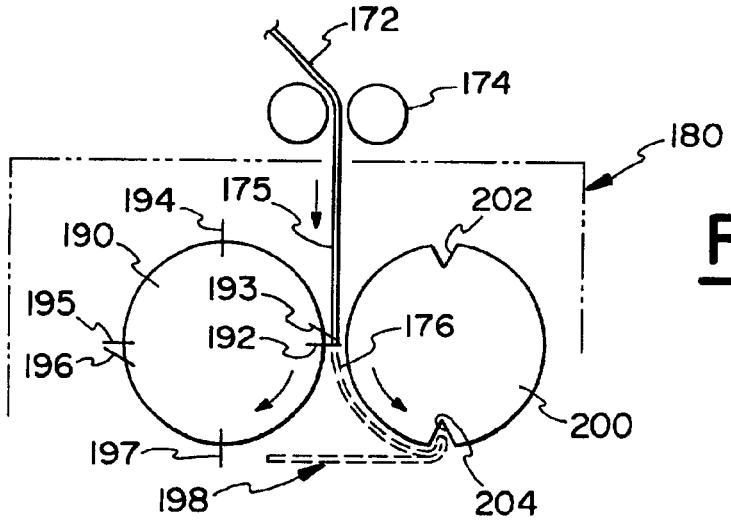
FIG. 16A is a schematic view of the folder unit illustrating the initial folding stage.
Figure 16B:
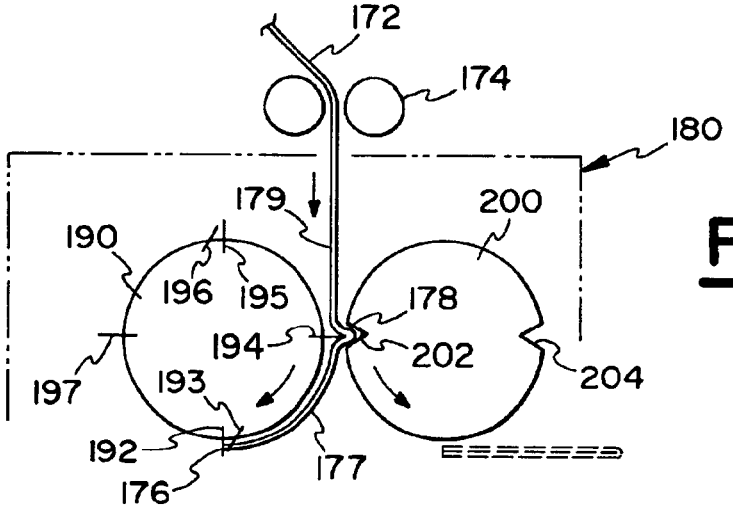
FIG. 16B is a schematic sectional view of the intermediate folding position of the publication folder of FIG. 16A.
Figure 16C:
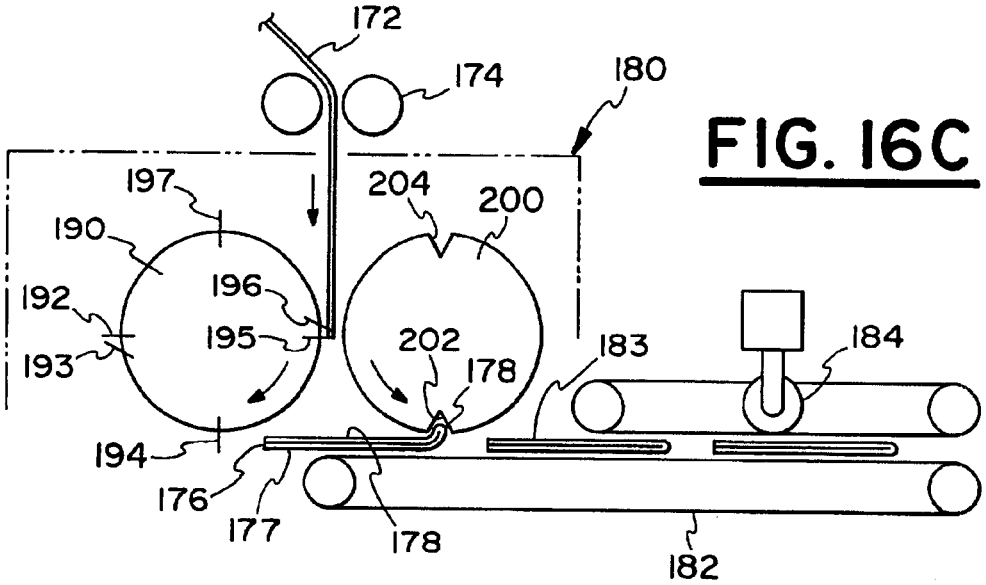
FIG. 16C is a schematic cross sectional view of the publication folder of FIG. 16A, showing the final cutoff stage.

The sequential operation of the folder unit is shown schematically in FIGS. 16A, 16B, and 16C. Referring to FIG. 16A, the composite ribbon 172 is passed through the nip rollers 174 as mentioned previously, and is fed directly into the modified publication folder unit 180.

The vertically descending composite ribbon 175 has the envelope ribbon on the side facing the rotating cylinder 200. The end of the composite web 176 is cut by blade 192 and simultaneously needle like pins 193 project outwardly and impale the free end section of the composite web.

The rotating cylinder 190 has a tucker blade 194, and a second cutting blade 195 as well as a second set of needle like retractable pins 196. These pins are arranged in a spaced row across the axial length of the cylinder 190. The cutting blade 192 is disposed diametrically across the cylinder from the cutting blade 195. Consequently for every half rotation of the cylinder, the incoming ribbon is severed to free the previously folded repeat web section 198. The half circumference of the rotating cylinder 190 between the two cutting blades is equal to the longitudinal repeat length R. It also should be noted that the pins 193 impale the leading edge 176 it to hold securely as the cylinder 190 rotates in a clockwise direction. The rotating and coacting tuck cylinder 200 has two diametrically opposed receiving cavities 202 and 204.

One of the concerns with the use of a publication folder for inline assembly was the accuracy of the cut and the fold. The direct mail composite ribbon of this invention is considerably smaller than the publication signature ribbon, and alignment problems were a possibility.

The publication folder unit of this invention is used for an entirely different type of product. Uncertainties as to whether differences in operating speed, bulk of the web processed, and other variables could effect operations of the newly interconnected equipment.

The knowledge of how a commercial publication folder unit operates, and the recognition of a new type of envelope construction, with the front and back panels of the envelope placed end to end, in a longitudinal ribbon, and closed by a clamshell type crossfold operation was an important realization. It was an outgrowth of the search for adding additional printed insert material to a direct mail package.

FIG. 16B illustrates the manner in which the cylinders 190 and 200 cooperate to make the crossfold at the repeat line of the incoming composite web 179.

The cylinders have rotated 90° from the position shown in FIG. 16A. The end of the composite web 176 is pulled around cylinder 190 in a clockwise direction, held on the cylinder surface by the pins 193. The 90° travel is one half a repeat length, so that the ribbon section 177 is a one half repeat. At this point the blade 194 projects into the cavity 202 of the counterclockwise moving cylinder 200. In so doing, it presses the ribbon along the half repeat line into the axially extending tuck receiving groove 202. The second half of the repeat section 179 has not as yet reached the two cylinders.

FIG. 16C shows the position of the cylinder 190 and 200 after they move rotated and additional 90° beyond the position of FIG. 16B.

The cutting blade 195 has severed the just folded repeat section 179 over the leading repeat section 177 which is now in alignment with its leading edge 176. The cylinder 200 has held the crossfold 178 of the repeat section, and pulled it and the composite ribbon with the repeat section 179, down and around the surface of cylinder 200 to the position shown, where it is severed by the blade 196.

The conveyer 182 then carries the completed package such as 183 to the pneumatic nip roller assembly 184 which presses the top and bottom edges of the envelope into firm engagement with the adhesive disposed between them.

Figure 17:
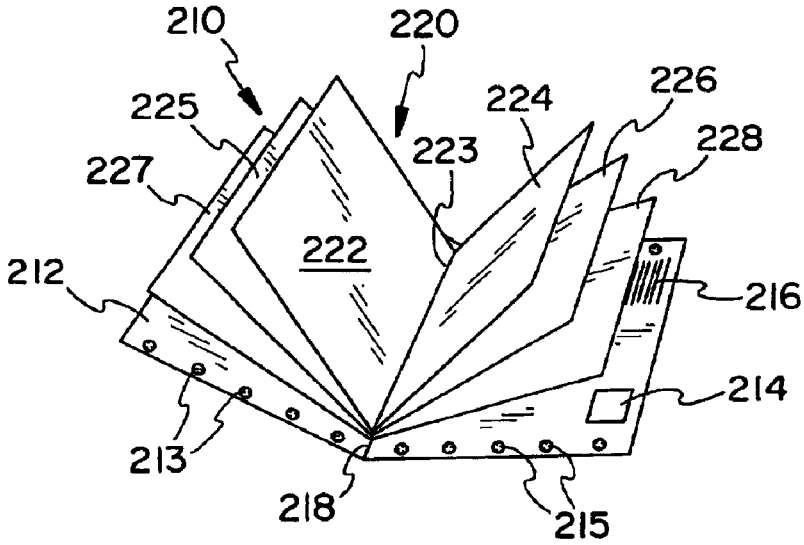
FIG. 17 is a perspective view of an opened inline crossfold package.

FIG. 17 is a perspective view of the opened inline crossfold package 210, after the envelope panels 212 and 214 have been pulled free of the adhesive dots 213 and 215. In this respect, it should be noted that the type of latex adhesive used to hold the envelope panels together will only adhere to matching adhesive on each of the two surfaces to be held together. The adhesive has a light resistance to release force so that the opened end of the package can easily be pulled apart. Panels 212, 214 on their inner surface, may have printed material such as advertising. The panels are joined along the common half repeat line 218.

The printed insert material generally, indicated at 220, has three loose sheets providing six panels 220, 224, 225, 226, 227, and 228 of printed material. The individual two page pieces can be removed and used independently as coupons or mail pieces.

Figure 18:
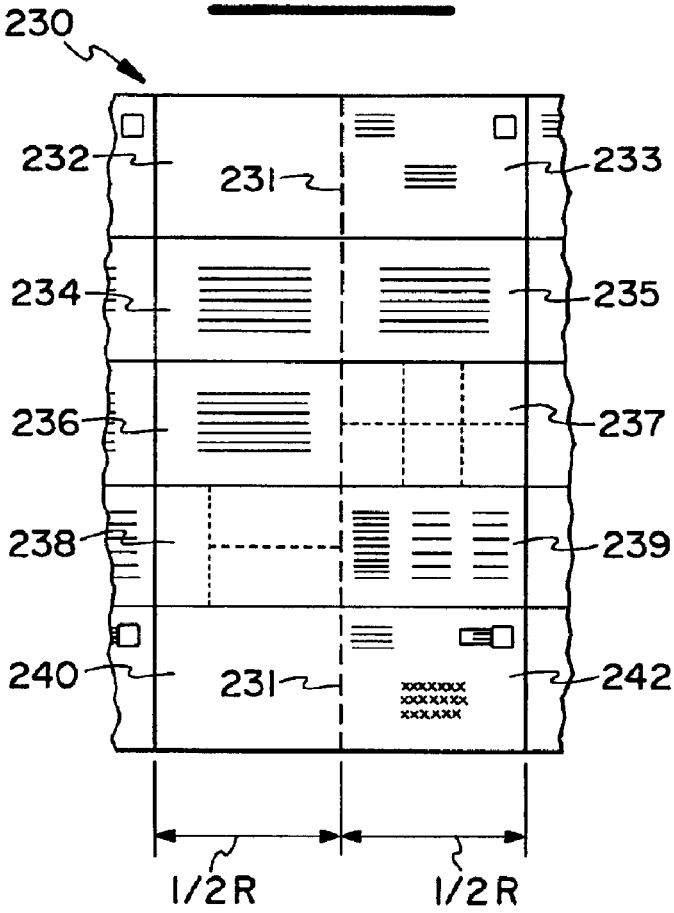
FIG. 18 is a reduced size plan view of a repeat, showing different types of insert pieces.

FIG. 18 shows a repeat layout 230 for a mailer package having different types of insert items.

The half repeat line 231 will be the common crossfold for all of the pieces in the repeat. The envelope panels 232 and 233 are at the top of the repeat. Adjacent panels 234 and 235, as well as panel 236, have general printing. Panel 237 is perforated to give six coupons. Panel 238 is also perforated as indicated by the dotted line to give three different removable pieces. Panel 239 is or can be an order form. Panels 240 and 242 are the panels of a return envelope, in which some of the enclosed material in the completed package can be returned.

While this invention has been described as having a preferred design, it is understood that it is capable of further modifications, and uses and/or adaptations of the invention, following in general the principle of the invention and including such departures from the present disclosure as come within the known or customary practice in the art to which the invention pertains, and as may be applied to the central features hereinbefore set forth, and which come within the scope of the invention or limits of the claims appended hereto.

What is claimed:

1. A method of making an inline package from a full repeat of a printed web, comprising:

a) printing on a web a series of longitudinally extending repeats, each repeat having a length twice the length of a mailer, and a longitudinally extending outer wrap strip, the outer wrap strip including end to end rectangular front and back panels, the outer wrap strip including a rectangular front wrap panel and a rectangular back wrap panel located adjacent to and extending longitudinally along the longitudinally extending outer wrap strip;

b) each repeat of the series of repeats including an insert section;

c) the insert section including a first insert, a second insert located adjacent to and extending longitudinally along the longitudinally extending repeat, and a third insert located adjacent to and extending transversely relative to and away from the first insert;

d) applying adhesive adjacent to the longitudinal edges of at least one of the front and back panels of the outer wrap strip;

e) separating the outer wrap strip from the insert section of the web;

f) forming the insert section into a plurality of strips of respective superposed lengths, each of which strips has a width slightly less than a lateral spacing between the adhesive applied to the outer wrap panels;

g) forming a composite ribbon by bringing the outer wrap strip and the insert strips into superposed and registered position with each other;

h) crossfolding a half of one repeat of the series of repeats of the composite ribbon back over another half of that one repeat, such that the front and back panels of the outer wrap strip fully enclose the folded insert repeat section;

i) pressing the longitudinal edges of the folded front and back panels together and into sealed engagement with the adhesive to thereby close the outer wrap strip to form the closed outer wrapper; and j) transversely cutting the closed outer wrap strip off from the composite ribbon at a succeeding repeat.

2. The method of making a mailer from a printed web, as set forth in claim 1, including the step of:

a) imaging personalized data on the outer wrap and the insert section prior to separating the outer wrap from the web repeat.

3. The method of making a mailer from a printed web, as set forth in claim 1, including the step of:

a) applying a latex adhesive as the adhesive applied to the at least one of the front and back panels of the outer wrap strip; and b) drying the adhesive after application.

4. The method of making a mailer from a printed web, as set forth in claim 1, including the step of:

a) applying the adhesive in a discontinuous series of adhesive.

5. The method of making a mailer from a printed web, as set forth in claim 1, including the step of:

a) longitudinally folding at least one imaging section of a repeat of the series of repeats after separation of the outer wrap strip, to form a folded insert strip of side by side panels.

6. The method of making a mailer from a printed web, as set forth, in claim 1, including the step of:

a) longitudinally cutting the insert section of the web to produce a plurality of insert strip ribbons.

7. A method of forming inline a crossfolded mailer with a folder unit, comprising:

a) providing a folder unit;

b) configuring the folder unit to receive in line an end of a composite mailer ribbon; selecting a printing web longitudinal repeat length equal to half a circumference of a folding unit second stage folding and cutoff cylinder;

c) printing on a web a selected repeat length which contains a mailer outer wrap strip extending the length of the repeat length and adjacent insert material;

d) applying adhesive along a longitudinally extending side of the outer wrap strip;

e) severing the outer wrap strip from the web;

f) forming an insert section of the web into a ribbon of superposed separate strips, the strips having a width slightly less than the lateral space between the adhesive on the outer wrap;

g) superimposing and registering the outer wrap strip and the insert strips to form a composite ribbon;

h) feeding an end of the composite ribbon directly into the second stage of the modified folder unit;

i) crossfolding back a leading half of the successive repeats at the end of the composite ribbon on its other half repeat to enclose the outer wrap over a narrower folded insert ribbon to form a crossfolded package;

j) severing the crossfolded package from the composite ribbon at a side opposite the fold line to form a severed side; and k) pressing longitudinal edges of the crossfolded package together to firmly engage the adhesive and to form three closed sides, whereby there is provided a cross-folded mailer closed on three sides and open on the severed side opposite the fold line.

8. The method of forming an open-ended mailer as set forth in claim 7, including the step of:

a) imaging personalized data on both the outer wrap strip and the insert section of the repeat prior to severing of the outer wrap strip from the web.

9. The method of forming an open-ended mailer as set forth in claim 7, wherein:

a) the adhesive includes a latex adhesive, and the latex adhesive is applied to the outer wrap.

10. The method of forming an open-ended mailer as set forth in claim 7, including the step of:

a) removing a first longitudinal folding stage of the folder unit.

* * * * *